US006868791B1

(12) United States Patent
Thompson et al.

(10) Patent No.: US 6,868,791 B1
(45) Date of Patent: Mar. 22, 2005

(54) SINGLE STAGE KINETIC ENERGY WARHEAD UTILIZING A BARRIER-BREACHING PROJECTILE FOLLOWED BY A TARGET-DEFEATING EXPLOSIVELY FORMED PROJECTILE

(75) Inventors: LaMar Thompson, Orange, NJ (US); William Ng, Fort Lee, NJ (US); Richard Fong, Boonton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/709,144

(22) Filed: Apr. 15, 2004

(51) Int. Cl.[7] ..... F42B 30/00
(52) U.S. Cl. ..... 102/476
(58) Field of Search ..... 102/475, 476

(56) References Cited

U.S. PATENT DOCUMENTS 5,792,980 A * 8/1998 Weimann ..... 102/476
6,035,785 A * 3/2000 Sabathier et al. ..... 102/476
6,308,634 B1 * 10/2001 Fong ..... 102/476
6,510,797 B1 * 1/2003 Fong ..... 102/476

* cited by examiner

*Primary Examiner*—Harvey E. Behrend
(74) *Attorney, Agent, or Firm*—Robert Charles Beam; John F. Moran

(57) ABSTRACT

A single stage kinetic energy warhead using multiple explosively formed projectile (EFP) liners in a stacked configuration is capable of breaching intermediate barriers and defeating a primary target. The main explosive charge is detonated and the subsequent shockwave causes the front liner to be shaped to breach an intermediate barrier. The main liner is formed into a more compact rod-shaped projectile designed to defeat the main target. The weight and volume of the stacked liner configuration of the present system is significantly lower than the weight and volume of current systems. The present system requires a single firing explosive train eliminating developmental cost and complex fusing. The present system utilizes explosive detonation, simplifying the delivery of a projectile and eliminating the need for a missile delivery system. The size and simplicity of the present system allows for portability and use by an individual.

7 Claims, 3 Drawing Sheets

SINGLE STAGE KINETIC ENERGY WARHEAD UTILIZING A BARRIER-BREACHING PROJECTILE FOLLOWED BY A TARGET-DEFEATING EXPLOSIVELY FORMED PROJECTILE

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention generally relates to the field of ballistics and in particular to explosively formed projectiles. More specifically, the present invention relates to an explosively formed barrier-breaching plate for clearing barriers in advance of an explosively formed projectile.

2. Background of the Invention

In tactical military exercises, primary targets are often blocked by intermediate barriers or obstacles. These obstacles can be fences, covers, forestry, or light armor. The intermediate barriers or obstacles can be breached by a preliminary manual labor operation. However, manual labor operations expose military personnel to harm and require time for planning and execution. As an alternative, the intermediate barriers or obstacles can be breached by current warhead systems comprising multiple warheads within a single envelope. However, these systems require multiple and complex explosive firing trains, are expensive, require a missile delivery system for deployment, and cannot typically be transported or deployed by an individual because of their size and weight.

A warhead comprising an explosively formed projectile can be used to clear barriers or obstacles. The explosively formed projectile uses an explosive energy to deform a metal plate into a coherent penetrator while simultaneously accelerating it to extremely high velocities, employing a kinetic energy penetrator without the use of a large gun. A conventional explosively formed projectile is comprised of one or more metallic liners, a case, an explosive section, and an initiation train. Typically, the explosively formed projectile comprises a retaining ring to position and hold the liner-explosive subassembly in place. Explosively formed projectiles produce one or more massive, high velocity penetrators. After detonation, the explosive products create enormous pressures that accelerate one or more liners while simultaneously reshaping the liners into a rod or some other desired shape. The explosively formed projectile then impacts the target at a high speed, delivering a significantly high mechanical power.

An EFP warhead configuration may be comprised of a steel case, a high-explosive charge, and a metallic liner. Explosively formed projectile warheads have been designed to project a one or more high velocity projectiles to attack armored targets. Although this technology has proven to be useful, it would be desirable to present additional improvements. What is needed is a warhead that is capable of breaching intermediate obstacles, clearing a path for subsequent explosively formed projectiles that can then effectively defeat a primary target. The need for such a system has heretofore remained unsatisfied.

SUMMARY OF INVENTION

A single stage kinetic energy warhead utilizes a barrier-breaching breaching projectile with a follow-through explosively formed projectile (EFP) capable of defeating a primary target. The single stage kinetic energy warhead is a single stage weapon using multiple explosively formed projectile liners in a stacked configuration. The forward liner is shaped to breach an obstacle. The main liner is formed into a more compact rod-shaped projectile designed to defeat the main target.

The weight and volume of the stacked liner configuration of the present system is significantly lower than the weight and volume of current systems. The single stage kinetic energy warhead requires a single firing explosive train eliminating developmental cost and complex fusing. The single stage kinetic energy warhead utilizes explosive detonation, simplifying the delivery of a projectile and eliminating the need for a missile delivery system. The size and simplicity of the single stage kinetic energy warhead allows for portability and use by an individual.

The single stage kinetic energy warhead comprises a main explosive charge surrounded by a metal housing. The front of the single stage kinetic energy warhead comprises stacked liners separated by a foam insert. The stacked liners comprise a main liner and a front liner. The charge is detonated from the rear of the single stage kinetic energy warhead by a detonator located in the back plate. A shockwave is produced that propagates radially toward the front of the single stage kinetic energy warhead. The detonation shockwave shapes the stacked liners and propels them toward the intended target. The front liner forms a large diameter plate (barrier-breaching projectile) for breaching barriers or obstacles. The main liner is shaped into an explosively formed projectile (EFP) designed to defeat heavily armored targets.

In one embodiment, the front liner forms a massive barrier-breaching projectile. The formation of the large diameter plate is dependent on design of the front liner and the single stage kinetic energy warhead. The barrier-breaching projectile formed by the front liner has sufficient energy to clear a path through an intermediate barrier or obstacle allowing the explosively formed projectile formed from the main liner to reach the primary target. The explosive charge using a single detonator generates sufficient energy to produce two sequential projectiles from a single warhead.

In a further embodiment, the front liner and the main liner comprise copper. In yet another further embodiment, the front liner and the main liner comprise silver. These more ductile materials (copper and silver) allow the shockwave to create a barrier-breaching projectile with a diameter larger than the diameter of the front liner. In further embodiments, the front liner and the main liner comprise different shapes and configurations, allowing for varying projectile lengths.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION

Figure 1:
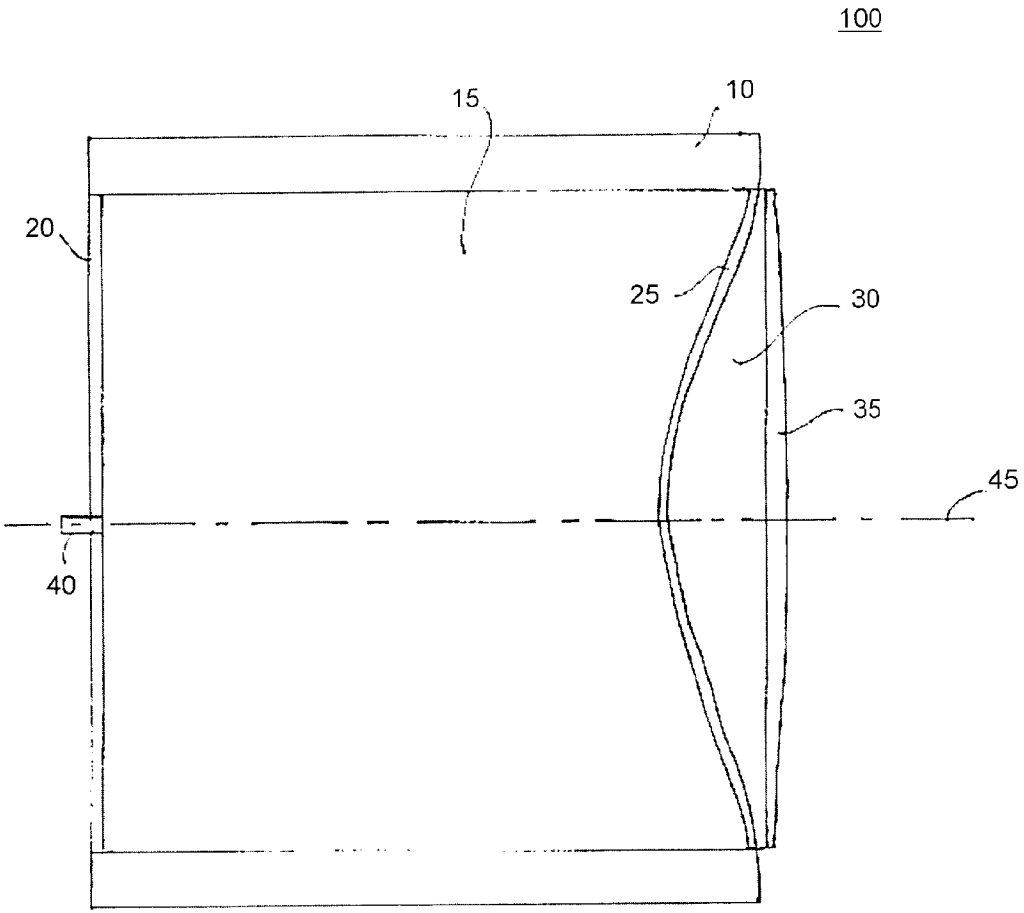
FIG. 1 is a cross-sectional view of a single stage kinetic energy warhead utilizing a barrier-breaching projectile followed by a target-defeating explosively formed projectile.
Figure 2:
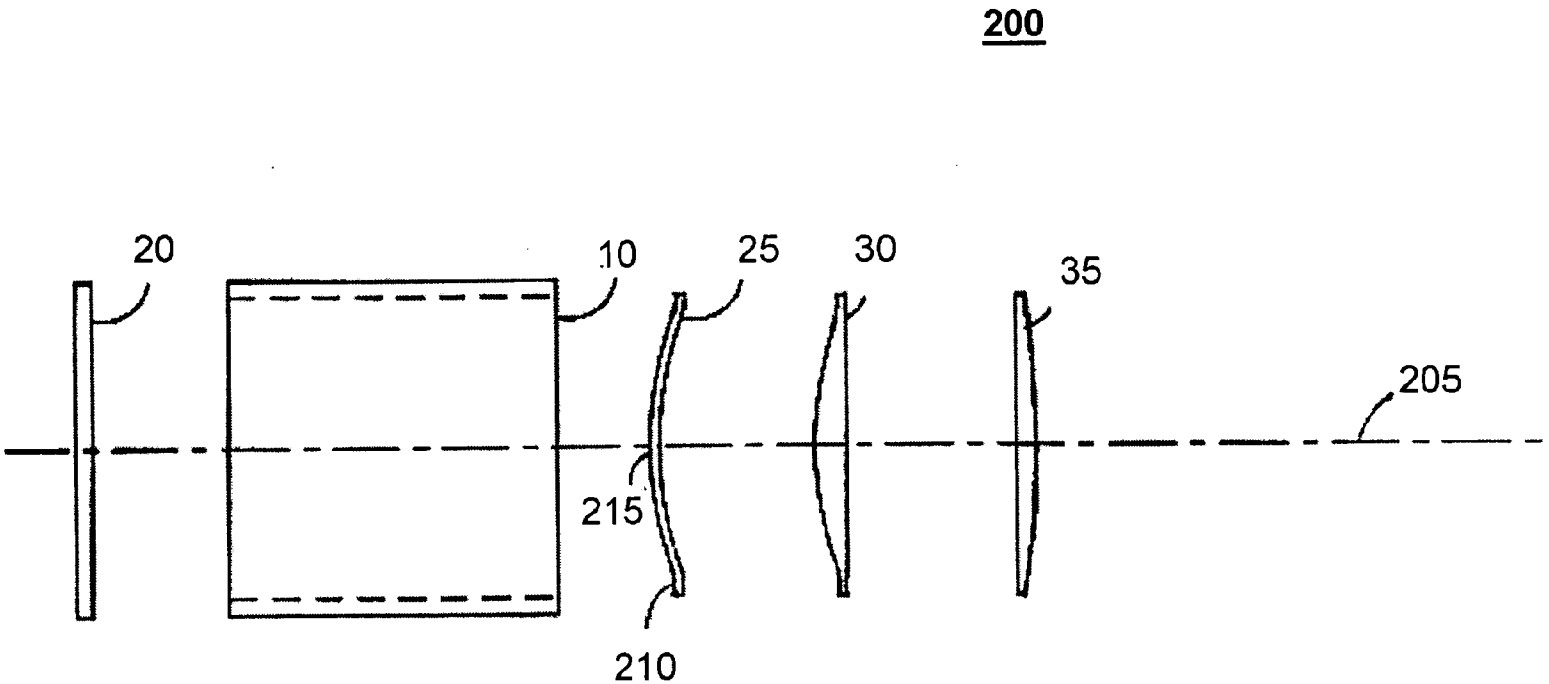
FIG. 2 is a cross-sectional exploded view of a projectile assembly of the single stage kinetic energy warhead of FIG. 1.

FIGS. 1 and 2 illustrate an exemplary embodiment of a single stage kinetic energy warhead 100 utilizing a barrier-breaching projectile followed by a target-defeating explosively formed projectile (also referenced herein as warhead 100) according to the present invention. Warhead 100 comprises a metal housing 10, a main explosive charge 15, a back plate 20, a main liner 25, a foam insert 30, a front liner 35, and a detonator assembly 40. Warhead 100 is cylindrical with respect to axis 45. The projectile assembly 200 of warhead 100 is illustrated by the diagram of FIG. 2. The projectile assembly 200 generally comprises metal housing 10, the back plate 20, the main liner 25, the foam insert 30, and the front liner 35 assembled along a central axis 205.

The back plate 20 and the metal housing 10 provide a protective casing for the main explosive charge 15 and the main liner 25. In addition, the mass of the metal housing 10 provides confinement for the main explosive charge 15. The addition of mass around the main explosive charge 15 and the main liner 25 increases the duration of the explosive impulse and hence the total energy delivered to the main liner 25 and the front liner 35. The material of choice for the back plate 20 and the metal housing 10 is typically steel because of its relative low cost, high strength, and density. However, other materials can alternatively be used (such as aluminum) as long as the mass is sufficient to provide the necessary confinement.

The density and the physical dimensions of the main explosive charge 15 are also of importance as they affect the formation of a projectile from the main liner 25 and the formation of a barrier-breaching projectile from the front liner 35.

The main liner 25 is curved and generally dome (or bell) shaped. As indicated in FIG. 2, the main liner 25 has a generally circular peripheral rim 210 and a concave surface 215. The main liner 25 is placed inside the metal housing 10 against the main explosive charge 15 such that the concave surface 215 of the main liner 25 is curved toward the back plate 20. The rim 210 of the main liner 25 abuts against and is secured to the inner surface of the metal housing 10. The main liner 25 may comprise iron, tantalum, copper, or a material of like composition. The main liner 25 can also comprise metallic materials such as silver, tungsten, or depleted uranium. In an embodiment, the main liner 25 averages between 0.100 inch and 0.150 inch thick if of copper, or a similarly thinner piece of tantalum.

The front liner 35 is a circular flat plate placed on the front of warhead 100. The front liner 35 is spaced from the main liner 25 by a foam insert 30. The front liner comprises, for example, copper or silver. Each liner or flat plate embodiment including the foam is typically 4.5 inches or 6 inches for integration into shoulder fired or rocket launched gun and missile systems. The thickness of foam on the edge is relatively twice the thickness of front liner 25.

Back plate 20 is placed flush to metal housing 10. Metal housing 10 is formed as a hollow cylindrical with an inside diameter of approximately 4.5 or 6 inches. The main explosive charge 15 is shaped as a cylinder. The main explosive charge 15 comprises, for example, LX-14, OCTOL, hand packed C-4, or some other solid explosive, and is machined or hand-packed to fit snugly within the inside of the housing. In addition, the main explosive charge 15 is machined to comprise a countersunk recess in its forward end for receiving snug placement of the main liner 25.

Figure 3:
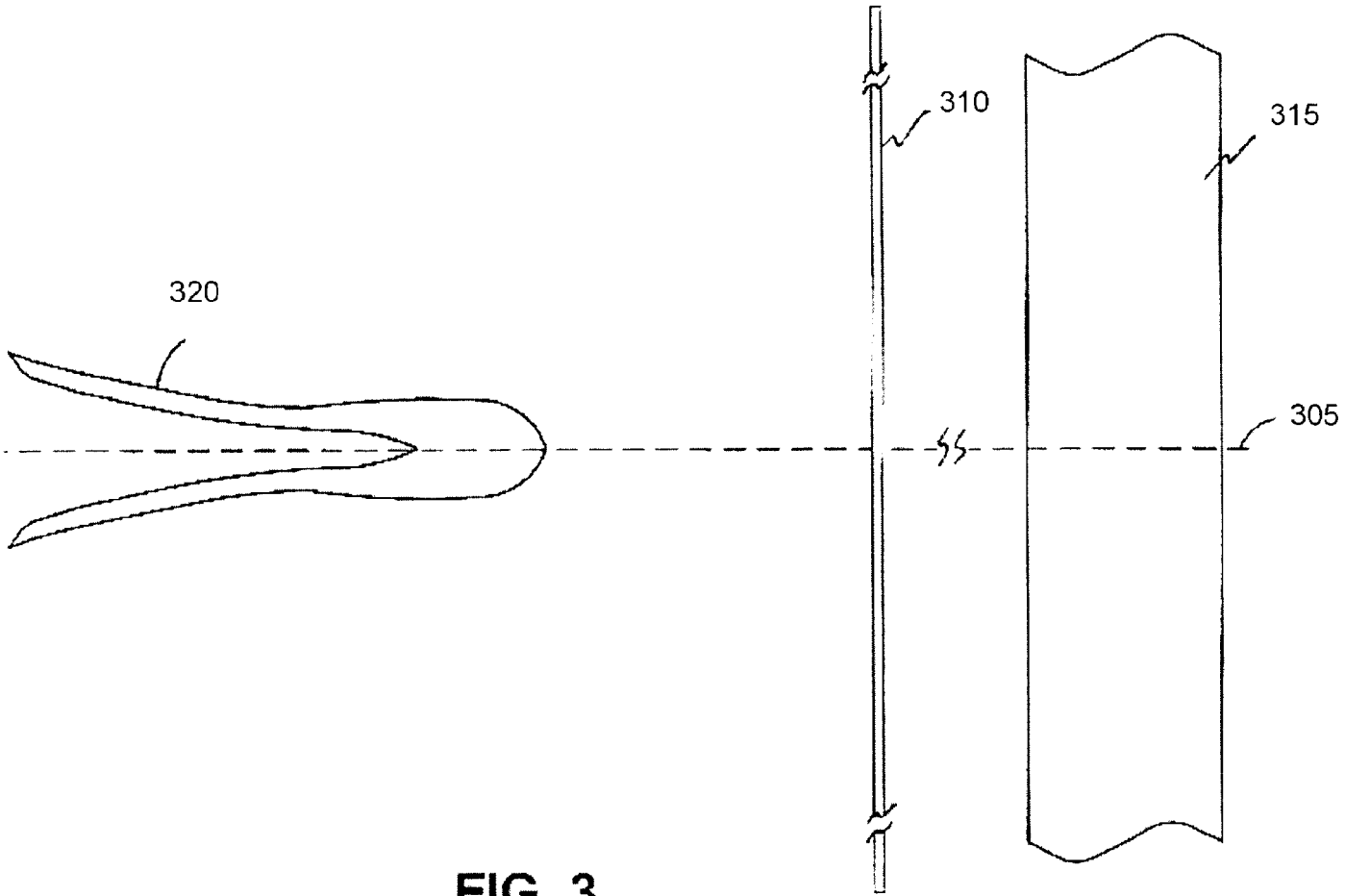
FIG. 3 is a cross-sectional view of a barrier-breaching projectile and a target-defeating explosively formed projectile formed by firing the single stage kinetic energy warhead of FIGS. 1 and 2, traveling in tandem along a single trajectory just before target impact.

In operation, the detonator assembly 40 initiates the main explosive charge 15. A shockwave created by detonation of the main explosive charge 15 propagates radially through the metal housing 10 toward the front of warhead 100. As illustrated by the diagram of FIG. 3, the front liner 35 is shaped along an axis 305 into a large diameter plate 310 (also referenced herein as barrier-breaching projectile 310) designed to clear a path through any intermediate barrier between warhead 100 and a heavily armored target 315. The main liner 25 is shaped along axis 305 into an explosively formed projectile (EFP) 320 designed to defeat the heavily armored targets 315. The explosively formed projectile 320 travels through the path cleared by the barrier-breaching projectile 310.

The detonator assembly 40 is physically positioned between back plate 20 and the back end of main explosive charge 15. Because of the explosive burning of the main explosive charge 15, a shock wave is typically propagated along axis 305 in the form of ever expanding hemispheres that are concentric around the detonation point (if there is a single point of detonation). However, with spaced apart, judiciously placed multiple points of detonation, the shock wave front is more nearly like a plurality of plane waves, propagating straight forward down the metal housing 10 (FIG. 1) towards the main liner 25, being nearly plane perpendicular to the central axis 45 of the metal housing 10. Creating plane waves rather than hemispherical waves imparts maximum pressure to deform and propel the main liner 25 and the front liner 35.

The detonator assembly 40 comprises, for example, RDX, PETN, RXN, and can be arranged in many detonation configurations. For example, the detonator assembly 40 may be configured as a high voltage detonator into an explosive train, or a standard Army blasting cap, a line detonator across the back end of the explosive billet, or plural line detonators that intersect at near equal angles through the center of the back end of the main explosive charge 15. Electrical wires may be routed out of the warhead 100 between the back plate 20 and back end of the main explosive charge 15, if needed.

What is claimed is:

1. A single stage kinetic energy warhead utilizing a barrier-breaching projectile followed by a target-defeating explosively formed projectile, the warhead comprising:

a housing having an inner surface;

an explosive charge disposed within the housing;

a first liner that is placed against the explosive charge within the housing;

a plastic insert that is placed against the first liner;

a second liner that is placed against the plastic insert;

wherein the first liner is generally concave shaped wherein the second liner is generally flat;

wherein the plastic insert spaces the second liner from the first liner;

wherein when the second liner is expelled from the housing ahead of the first liner, the second liner forms a plate shaped projectile;

wherein when the first liner is expelled from the housing, the first liner is deformed into a convex shaped projectile;

wherein the plate shaped projectile clears a path through a barrier that protects a target, for the convex shaped projectile to impact the target unimpeded; and wherein the explosive charge uses a single detonator to produce two sequential projectiles.

2. The single stage kinetic energy warhead of claim 1, wherein the first liner comprises a first peripheral rim;

wherein the second liner comprises a second peripheral rim; and wherein the first and second peripheral rims abut against an inner surface of the housing.

3. The single stage kinetic energy warhead of claim 1, wherein the plastic insert comprises a foam material.

4. The single stage kinetic energy warhead of claim 1, further comprising a detonator assembly that initiates the explosive charge.

5. The single stage kinetic energy warhead of claim 1, further comprising a back plate.

6. The single stage kinetic energy warhead of claim 1, wherein the first liner and the second liner are coaxially aligned so that the first liner and the second liner follow substantially a similar flight trajectory when the first liner and the second liner are expelled from the housing.

7. The single stage kinetic energy warhead of claim 3, wherein the plurality of first liners and the second liner are coaxially aligned so that the plurality of first liners and the second liner follow substantially a similar flight trajectory when the plurality of first liners and the second liner are expelled from the housing.

* * * * *